US006691954B1

(12) United States Patent
Harrington et al.

(10) Patent No.: US 6,691,954 B1
(45) Date of Patent: Feb. 17, 2004

(54) INTEGRATED KITE CONTROL BAR AND CONTROLLED TENSION RELEASE SAFETY DEVICE

(75) Inventors: Ross Davis Harrington, Victoria (CA); Richard Kerr Myerscough, Victoria (CA); Frank Ellison White, Saanichton (CA); Geoffrey Michael Wood, Sidney (CA)

(73) Assignee: Ocean Rodeo Sports Inc., Saanichton (CA)

( * ) Notice: Subject to any disclaimer, the term of this patent is extended or adjusted under 35 U.S.C. 154(b) by 0 days.

(21) Appl. No.: 10/313,026

(22) Filed: Dec. 6, 2002

Related U.S. Application Data

(60) Provisional application No. 60/334,926, filed on Dec. 28, 2001.

(51) Int. Cl.[7] ..... A63H 27/08

(52) U.S. Cl. ..... 244/155 A; 244/155 R

(58) Field of Search ..... 244/155 A, 155 R, 244/151 A, 151 B, 153 R, 900; 114/39.18, 39.16; 182/3; 441/73; 280/810

(56) References Cited

U.S. PATENT DOCUMENTS

| | | | | | |
|---|---|---|---|---|---|
| 4,127,247 | A | * | 11/1978 | Strasilla | 244/152 |
| 4,708,078 | A | | 11/1987 | Legaignoux et al. | |
| 5,134,951 | A | * | 8/1992 | Nishimura | 114/39.18 |
| 5,213,289 | A | * | 5/1993 | Barresi | 244/145 |
| 5,366,182 | A | * | 11/1994 | Roeseler et al. | 244/155 R |
| 5,417,390 | A | * | 5/1995 | Southwick | 244/155 A |
| 6,260,803 | B1 | * | 7/2001 | Hunts | 244/155 R |
| 6,273,369 | B1 | * | 8/2001 | Nishimura et al. | 244/155 A |
| 6,513,759 | B2 | * | 2/2003 | Starbuck | 244/155 A |
| 6,520,454 | B2 | * | 2/2003 | Winner | 244/155 A |
| 6,581,879 | B2 | * | 6/2003 | Bellacera | 244/155 A |

FOREIGN PATENT DOCUMENTS

| | | |
|---|---|---|
| FR | 2698847 | 6/1994 |
| FR | 2762583 | 10/1998 |

* cited by examiner

*Primary Examiner*—Charles T. Jordan
*Assistant Examiner*—T. Nguyen
(74) *Attorney, Agent, or Firm*—Oyen Wiggs Green & Mutala

(57) ABSTRACT

This invention is directed to a novel integrated kite control bar and controlled tension release safety device for use in kite boarding. More particularly, this invention pertains to an integrated kite control bar and controlled tension release safety device which can be activated by a kite boarder by moving the control bar against a safety release device. A kite control bar and safety release device comprising: (a) a kite control bar; (b) a center line associated with the kite control bar and having a first end and a second end; (c) a safety release device associated with the first end of the center line on a first side of the control bar; (d) a hook engaging loop associated with the second end of the center line, on a side of the control bar opposite to the safety release device, and being linked to the safety release device, said loop being openable when the control bar is advanced against the safety release device at the first end of the center line.

18 Claims, 7 Drawing Sheets

INTEGRATED KITE CONTROL BAR AND CONTROLLED TENSION RELEASE SAFETY DEVICE

This application claims the benefit of provisional application No. 60/334,926 filed Dec. 28, 2001.

FIELD OF THE INVENTION

This invention is directed to a novel integrated kite control bar and controlled tension release safety device for use in kite boarding. More particularly, this invention pertains to an integrated kite control bar and controlled tension release safety device which can be activated by a kite boarder by moving the control bar against a safety release device.

BACKGROUND OF THE INVENTION

The sport known as kite boarding has developed rapidly in popularity over the past two decades. In one aspect, kite boarding involves a kite boarder who stands on a surf board on water, in reasonably windy conditions, and has a harness fastened around his or her waist and buttocks or chest. A control bar is attached to the harness at the rear end and at the front end it is attached by front and back lines to a kite, which can be any suitable line traction kite. The kite boarder then launches the kite into the air by pulling on the front and back lines so that the wind inflates the kite and pulls the kite boarder and surf board over the surface of the water. If the wind is strong enough, the kite boarder can actually launch himself or herself into the air for a brief period of time. The kite boarder can also perform assorted tricks and maneuvers while being pulled by the kite. Kite boarding can also be performed on land, ice or snow.

High performance kite flying and kite boarding on land/snow/ice/water require in some instances a kite with multiple control lines (two to four, and potentially more) for performance and practical reasons. Use of multiple control lines is required to provide control, stability and the capability to fly kites in weather conditions where control of the leading and/or trailing edges of the kite is desirable and important. These higher performance kites also generally now require the use of a control bar and safety device for line attachments for the kite control and for wrapping lines on as they can approach 50 meters in length. To date, the preferred methods of attaching a safety device have been through wrist to line attachments that are activated when the user releases the control bar and the kite is then held to the user effectively by a single line attached to the kite edge. Releasing all but one line effectively collapses and de-powers the kite. Several existing modifications of this simple principle have been developed, and at least one concept has been patented.

French Patent No. FR 2698847, Legaignoux, published Jun. 10, 1994, discloses a flexible wing line system, comprising supporting and control lines, with control lines which can be located inside hollow supporting lines for most of their length. The lines, especially for a flexible aerodynamic wing in the shape of a section of a sphere, are in the form of two supporting lines for the load, connected to pointed tips of equal length, and a pair of control lines which also support the load and are connected to the wing's leading or trailing edge at the sides of the wing. In a variant of the design, the lines can incorporate an additional pair of control lines, attached to the opposite edge of the wing to the first pair. The main supporting lines can be hollow, with the control lines located inside them for the greater part of their length, and both the supporting and control lines can be made from a material with a low friction coefficient, preferably of polyethylene. The control lines can be equipped with handles to facilitate their operation.

U.S. Pat. No. 4,708,078, Legaignoux et al., issued Nov. 24, 1987, discloses a dual layer light wing, configured like a spherical segment, which is intended to be used in the traction and lift of various loads. The wing includes a leading edge and a trailing edge and an inflatable armature covered by the exterior and interior sheets of the flexible envelope. The surfaces of the wing are configured in the shape of an aircraft wing profile and the edges of the wing curve in two planes. The leading and trailing edges of the wing are oriented to intersect near the tips of the wing, and each of the tips of the wing receives a control rope via an adjusting plate. The control rope is passed through a pulley mounted on a craft to be displaced by a person through a harness. The wing can be used in sliding sports, yachting and gliding.

French Patent No. FR 2762583, Legaignoux, published Oct. 30, 1998, discloses a control system for the angle of incidence and direction of an ellipsoidal sail in the shape of a spherical lune comprising four lines, two at each distal end. One of the two lines is fixed in front of the optimum centering point of the sail and the other line is fixed behind this point. The shape of the sail is modified by displacement of its distal ends into the shape of points relative to the centering point. The leading edge formed by an inflatable spar has a cut out crescent shape at its ends. The control has a reduced number of lines compared with prior versions.

SUMMARY OF INVENTION

The invention is directed to a kite control bar and safety release device comprising: (a) a kite control bar; (b) a centre line associated with the kite control bar and having a first end and a second end; (c) a safety release device associated with the first end of the centre line on a first side of the control bar; and (d) a hook engaging loop associated with the second end of the centre line, on a side of the control bar opposite to the safety release device, and being linked to the safety release device, the loop being openable when the control bar is impinged against the safety release device at the first end of the centre line.

The safety release device can be linked to the hook engaging loop by a trigger line which passes through the interior of the centre line, which can be hollow, or alternatively, external of the centre line. When the trigger line is pulled by the safety release device being contacted by the control bar, it can activate a release mechanism which enables the hook engaging loop to be opened by being separated at one end from the centre line.

The trigger line, when activated by the safety release device, can unfurl a hook and pile fastener or a snap and pin fastener, which secures a free end of the hook engaging loop, thereby enabling the loop to be opened. Alternatively, the free end of the hook engaging loop can be connected to the second end of the centre line by means of a pin and loop combination. The centre line and the trigger line can be housed in a hollow tube.

The safety release device at the first end of the centre line can be a collar or sphere which can be connected to a first end of the trigger line which can pass through the interior of the hollow centre line.

On a first end of the safety release trigger device, there can be a resistance mechanism that controls the amount of force that is required to activate the release device thereby enabling the user to adjust the force that is required to activate the safety release device. In one aspect, the resistance mechanism can be a plastic tubing that has slits on a part of its sides covered with a flexible tube.

A second end of the trigger line can be secured to the hook and pile fastener which when unfurled by tension applied by the trigger line, can enable the loop to separate at its free end.

A manual release lever can be included with the hook and pile fastener or other fastener to enable the hook and pile or other fastener to be unfurled if it is not activated by tension on the trigger line. The release mechanism can be a tube and pin combination, and the trigger line can pull the tube off the pin and release the pin, thereby enabling the loop to be opened. An adjustable compression or tension device can be included with the tube and pin to adjust the release force.

The adjustable compression or tension device can be a spring or a resilient polymer.

The invention is also directed to a method of releasably securing a kite boarder to a kite which comprises fitting the kite boarder with a harness, the harness being connected to front and back lines of the kite, and a control bar and release safety device being positioned between the harness and the front and back lines of the kite, said control bar and safety release device comprising: (a) a kite control bar; (b) a centre line passing through the kite control bar and having a first end and a second end; (c) a safety release trigger device associated with the first end of the centre line on a first side of the control bar; and (d) a hook engaging loop associated with the second end of the centre line, on a side of the control bar opposite to the safety trigger release device, and being linked to the safety release trigger device, said loop being openable when the control bar is impinged against the safety release device at the first end of the centre line.

The kite boarder can release himself or herself from the front and back lines of the kite by contacting the safety release device with the control bar, thereby enabling the loop to be detached from the harness.

BRIEF DESCRIPTION OF DRAWINGS

In drawings which illustrate specific embodiments of the invention, but which should not be construed as restricting the spirit or scope of the invention in any way.

DETAILED DESCRIPTION OF THE INVENTION

Figure 1:
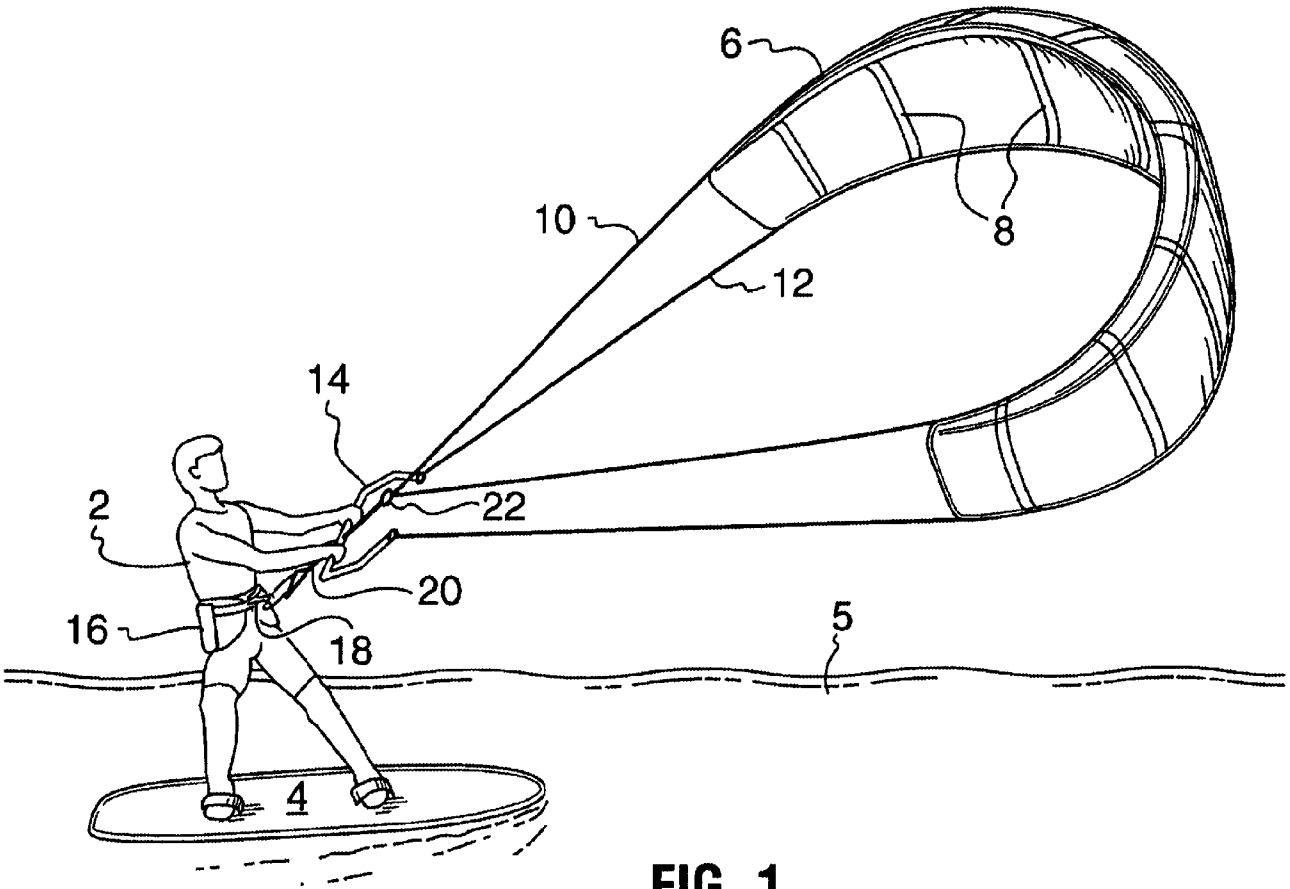
FIG. 1 illustrates a perspective view of a kite boarder standing on a surf board and being pulled over the water by a kite, with front and back lines secured to a control bar and a harness fitting around the waist and buttocks of the kite boarder.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Kite boarding is a recently developed exciting and thrilling sport which combines the use of a surf board and a kite which when powered by the wind draws the kite boarder and the surf board rapidly over the water. The subject invention recognizes that the sport of kite boarding is greatly advanced by enhancing its safety. All aspects of the kite/lines/control system can be integrated to provide the user with a system that is controllable and capable of releasing the kite under the most severe circumstances. The current invention enables the control bar to have an integrated kite and lines safety release mechanism.

Kite boarding can be a dangerous sport because gusts of wind can cause the kite to accelerate rapidly and in certain cases, if the gust is sufficiently strong, the kite can actually pull the kite boarder and the surf boarder off the surface of the water and dangerously high into the air, or alternatively, drag the surfboarder underwater, or across the ground if on land. In such cases, the kite boarder may find himself or herself in a dangerous or hazardous situation and will want to release himself or herself from the control bar and the kite. Existing control bar and harness designs have a manual release knob. However, use of the manual release knob in rapidly escalating danger situations is not usually convenient because the kite boarder must let go of the control bar with one hand in order to grab the manual release knob. Control of the control bar is not easy with only one hand so the control bar, by being pulled strongly by the kite, can lose control, thereby exacerbating the hazardous situation.

The following description involves a four line kite, which is common, but it may be applicable without restraint to other configurations. In normal use, the user places an open-hook harness (attached as shown to the user's body) (see FIGS. 1 and 3) into a mid-loop that is attached to the control lines. Use of this mid-loop allows the user to directly power and de-power the kite by effectively modifying the pull on the control lines, and changing the air-foil characteristics of the kite. This will be referred to hereinafter as the line-control loop. A second harness loop may be used and directly attaches to the control bar, as shown, with the result that the power from the outermost two control lines is transferred to the user through the harness, and not through the user's arms. This will be referred to hereinafter as the bar-control loop. This is preferentially used under highly controlled and stable kiting situations. Use of the line-control loop only is typical under high-performance situations, including using large kites (relative to the wind speed), and in jumping, etc.

A traditional method of safety is to release the kite bar, which implies unhooking from the bar-control loop, as well as the line-control loop, and releasing the control bar. At this point, the control bar is free to be pulled away from the user, and a secondary safety line, attached to a wrist leash on the user and further attached to a single control line, is activated. This has the effect of supporting the kite from one point only (although other situations may be envisioned whereby the wrist leash safety line has other attachments). The kite will then collapse freely under the wind load with no more effective foil shape being retained by the lines, hence providing a safety escape for the user.

In a situation where the user is out of control and is still hooked into the harness loops, letting go of the bar may have little effect in that the lines are still active in flying the kite, and de-powering may not occur. An example of this is where there is so much wind force in the kite pulling the user, that the person is unable to physically draw the kite in and provide enough slack to the harness lines to then allow release of the lines from their harness hook. In other cases, release of one hand from the control bar can cause the kite to lose control. It is in these very situations that most of the injuries occur in today's kite boarding activities. Existing state-of-the-art is deficient in addressing the safety situation in that it only addresses the situation in which the user is already free of the harness lines (see, for example, U.S. Pat. No. 6,273,369, Nishimura, and references therein.)

According to the present invention, a mechanism is provided whereby the user can release himself or herself from the line-control loop, and also the bar-control loop, under severe situations. Two independent but common acting devices are provided, one a safety release governed by actions on the kite control bar, and the other a direct release manual system that can be activated if the kite bar is out of the user's control.

The bar action mechanism is initiated by a firm push forward by the user on the control bar against a release device. The safety release device has a defined and controllable minimum activation load (greater typically than any flying loads) and is positioned along the control lines such that when the load is greater than a pre-set load, it pushes the release device forward. This release device is connected mechanically to a release pin or other mechanism, which when pulled, allows the line-control loop to be opened and thus frees the user from the harness line to the line-control loop connection. The control bar can also be released and other traditional leash-type safety devices are then free to work correctly. Similar activation may be provided on the bar-control loop. This release mechanism according to the invention is independent of how the line and bar control loops are directed/attached at the kite boom, and several easily envisioned embodiments of the invention will be apparent to a person skilled in the art. The invention is not directly dependent on the use of a four line kite, but applicable to any number of kite control lines.

Additionally, it is provided that a second independent, but commonly acting device is provided to allow the user to activate the release pin without pushing on the control bar. This is discussed below in the form of a manual device acting at the same point as the above release pin, to allow the user to release the loop manually. The combination of these two operations enhances safety in all situations where the user is fixed into the harness lines and cannot properly release the tension and pull from the kite.

Figure 2:
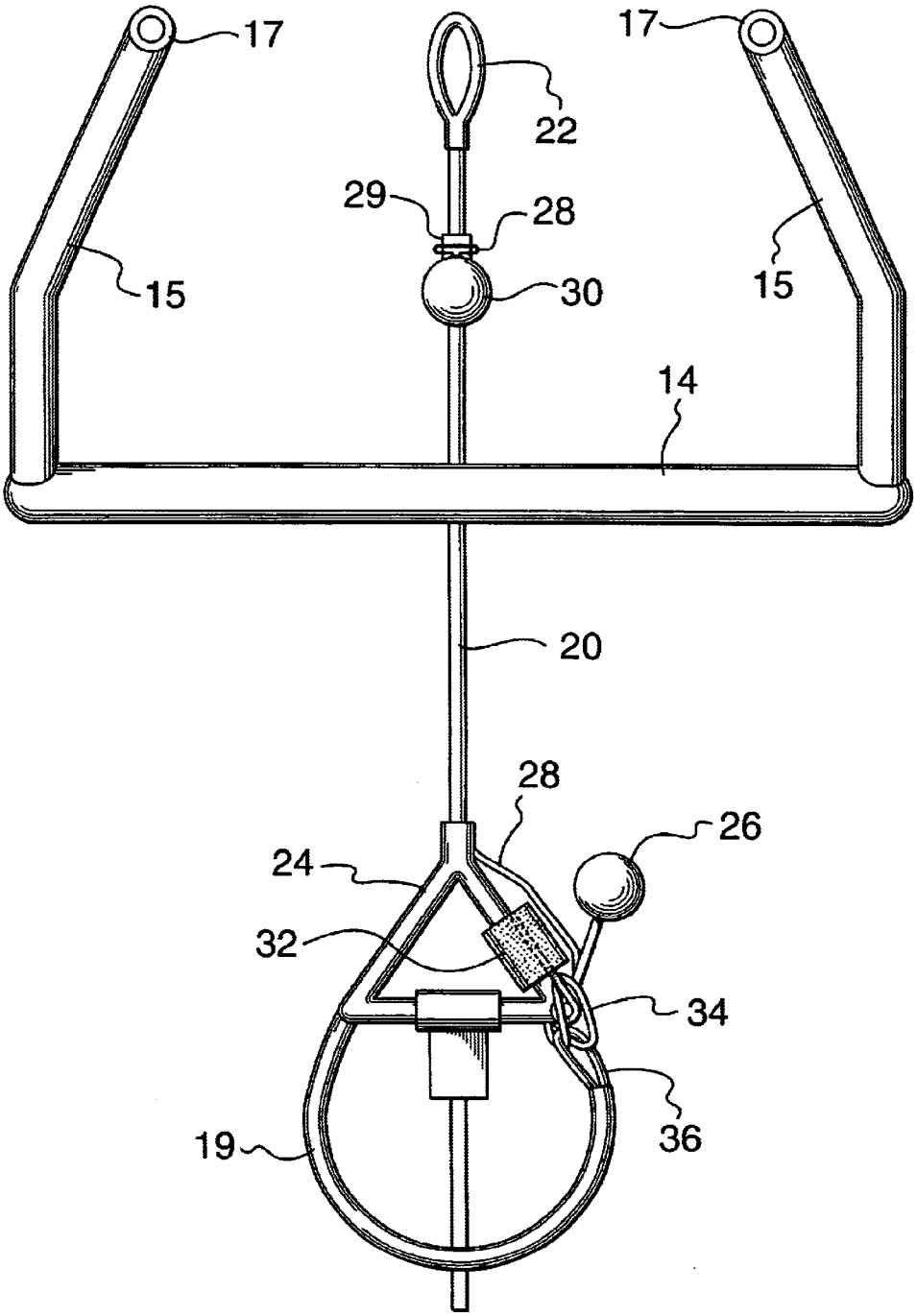
FIG. 2 illustrates a front view of one embodiment of the integrated kite control bar and controlled tension release safety device.

FIG. 1 shows a typical configuration of a harness, kite control bar, kite lines and kite especially as used by water, snow, or land kite-surfers, etc. It is easily envisioned that a user, hooked into this bar control at either the line-control or the bar-control loop, may not be able to release the bar under the tension from control lines, given kite power, user fatigue, etc. FIG. 2 shows the key features of a first embodiment of the invented system which allow the user to release from the kite under severe conditions. By pushing forward on the bar, the user activates the lower end of the release activator. An adjustable system is added to allow control of the activation loads for different users and kite sizes, and is embodied here by one such system (among many obviously possible) as a spring with compression loading. A simple screw threaded barrel can be used to provide adjustable spring compression as desired to modify release activation forces. It is obviously undesirable for the bar to release the loop under normal sailing situations and loads, so the user can be provided with an adjustment mechanism based on the particular conditions they are in.

We have invented a safety release system which is relatively simple in concept and extremely easy for the kite boarder to use. It takes advantage of the natural inclination of the kite boarder in a hazardous situation to push the control bar forward with both hands in a responsive effort to rid himself or herself of the control bar and the kite in a hazardous situation. Referring to FIG. 1, FIG. 1 illustrates a perspective view of a kite boarder standing on a surf board and being pulled over the water by a kite with front and back lines secured to a control bar and a harness fitting around the waist and buttocks of the kite boarder. As seen in FIG. 1, the kite boarder 2 stands over a surf board 4 which rides on the surface of the water 5. The kite boarder 2, by means of a control bar 14, and a pair of front lines 10 and back lines 12, is attached to a kite 6 which includes a series of air inflated stiffener struts 8. The inflated stiffener struts 8 serve two purposes, namely, maintaining the concave shape of the kite 6 so that it has maximum efficiency in catching the wind and keeping the kite 6 afloat when it lands on the water 5. While a parabolic type kite is shown in FIG. 1, it is understood that the safety device according to the invention can be used on all types of traction control kites including a kite identified with the trademark Ram-Air, framed kites, and dual membrane kites.

The control bar 14 is moved forward and backward along a centre line 20, which is secured to a depower trim loop hook 18, which in turn is secured to a harness 16 which is worn about the waist and buttocks of the kite boarder 2. The pair of front lines 10 are secured to a loop at the front end of the centre line 20. The pair of back lines 12 are secured to each arm of the control bar 14. By moving the control bar 14 forwardly or rearwardly on the centre line 20, the kite boarder 2 is able to control the back lines 12 and hence the pitch of the kite 6 and in turn control the lift of the kite 6. The kite 6 shown in FIG. 1 is manufactured from a single ply sheet, rather than a double ply or double surface kite as available on the market, but it is understood that the invention can be used with double ply kits or other designs of traction kites.

Referring to FIG. 2, FIG. 2 illustrates a front view of the integrated kite control bar and control tension release safety device. As seen in FIG. 2, the integrated kite control bar and controlled tension release safety device is constructed so that the control bar 14 can be moved upwardly or downwardly (forwardly or rearwardly) on the centre line 20. The control bar 14 can also be rotated about the centre line 20 to enable the kite boarder to control the lateral slant of the kite. The control bar 14 has at each end a pair of forwardly extending arms 15 with a pair of back line rings 17 each end. The centre line 20 is hollow and has at the top end thereof a front line loop 22 which is used for securing the loop 22 to the pair of front lines 10 (see FIG. 1). A trigger ball 30 and the top end of a trigger line 28 are also located at the top end of the centre line 20 above the control bar 14. The trigger ball 30 includes an adjustable force resistance mechanism 29 between it and the loop attachment 22 to the kite lines. The resistance mechanism 29 on the first end of the safety release trigger device controls the amount of force that is required to activate the release device. The resistance mechanism can be a metal spring or plastic tubing that has slits on a part of its sides covered with a flexible tube. The resistance mechanism 29 ensures that the control rod 14 when it hits ball 30 with minimum force does not prematurely release the loop 19. The centre line 20, being hollow, enables the trigger line 28 to pass down the interior of the centre line 20 and appear at the lower end of the centre line 20 in association with the depower trim loop 19. The depower trim loop 19 is flexible and is secured to one side of a stiff triangle 24 which is firmly secured to the bottom of the centre line 20. A hook and pile fastener 32 (Velcro) is wrapped around one side of the triangle 24. It is understood that other designs of release devices can be used, such as a snap and pin device. The bottom end of the centre trigger line 28 emerges from the bottom end of the centre line 20 and at its bottom end is secured to the hook and pile fastener 32. FIG. 2 also illustrates as a secondary back-up release feature, a manual safety release 26 which is pivotally connected to the triangle 24 and when pulled downwardly, pulls on the trigger line 28, which in turn unfurls (unwraps) the hook and pile fastener 32, thereby enabling the depower trim loop 19 to open.

Figure 3:
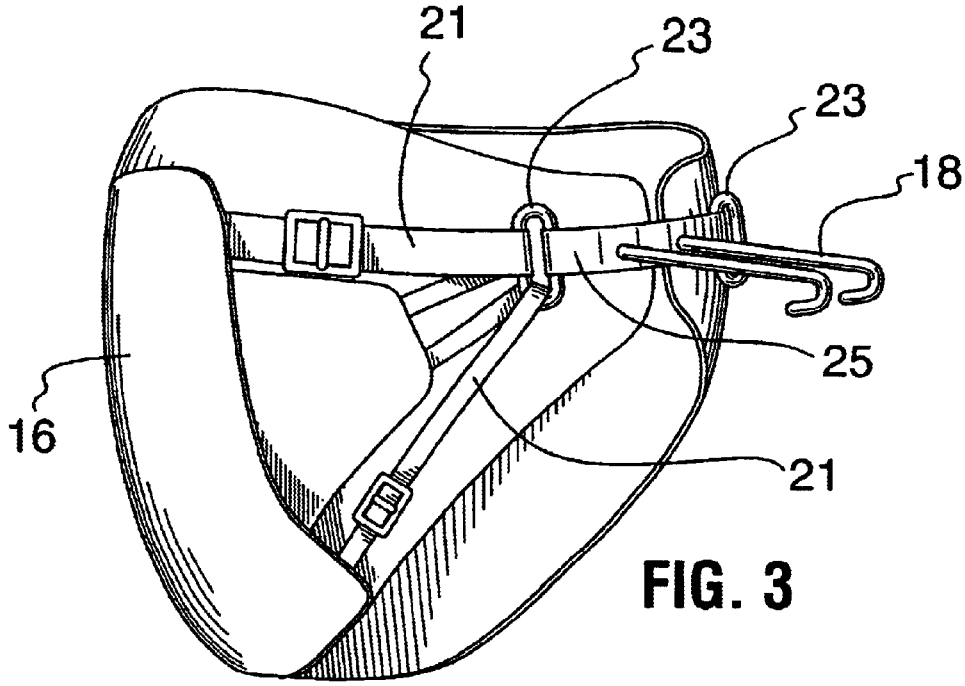
FIG. 3 illustrates an isometric view of a harness equipped with a hook.

FIG. 3 illustrates an isometric view of a harness equipped with a loop hook 18. As seen in FIG. 3, the harness 16 includes a series of buckle adjustable belts 21 and metal loops 23 which enable the harness to be securely wrapped around the waist and buttocks of the kite boarder. The belts 21 and steel loops 23 also are secured to a steel cross bar 25 with a loop hook 18 which is constructed of a strong metal such as steel.

Figure 4:
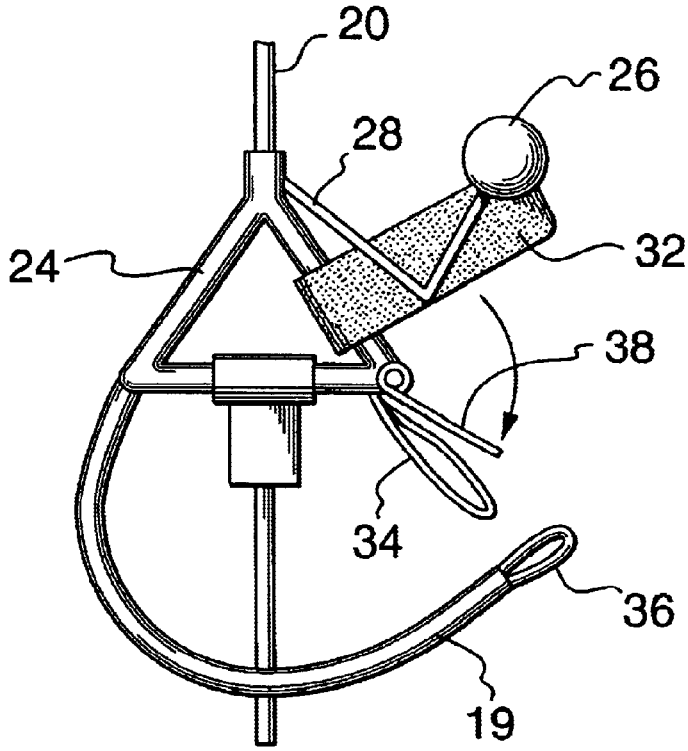
FIG. 4 illustrates a front view of a depower trim loop as it appears when released by activating a trigger line.

FIG. 4 illustrates a front view of a depower trim loop 19 as it appears when released to an open position by activating a trigger line. As illustrated in FIG. 4, the depower trim loop 19 has been opened in the following manner. The trigger line 28 emerging from the bottom end of the centre line 20 and the triangle 24 has been pulled to unfurl the hook and pile fastener (Velcro) 32. Unfurling the hook and pile fastener 32 releases the pivotal steel pin 38 and the release loop 34. Normally, when the loop 19 is closed, the pin 38 and loop 34 engage the hook loop 36 at the end of loop 19. When opened in this manner, the depower trim loop 19 releases from the depower trim loop hook 18 of harness 16 which in turn enables the kite boarder to be disengaged from the kite 6.

Figure 5:
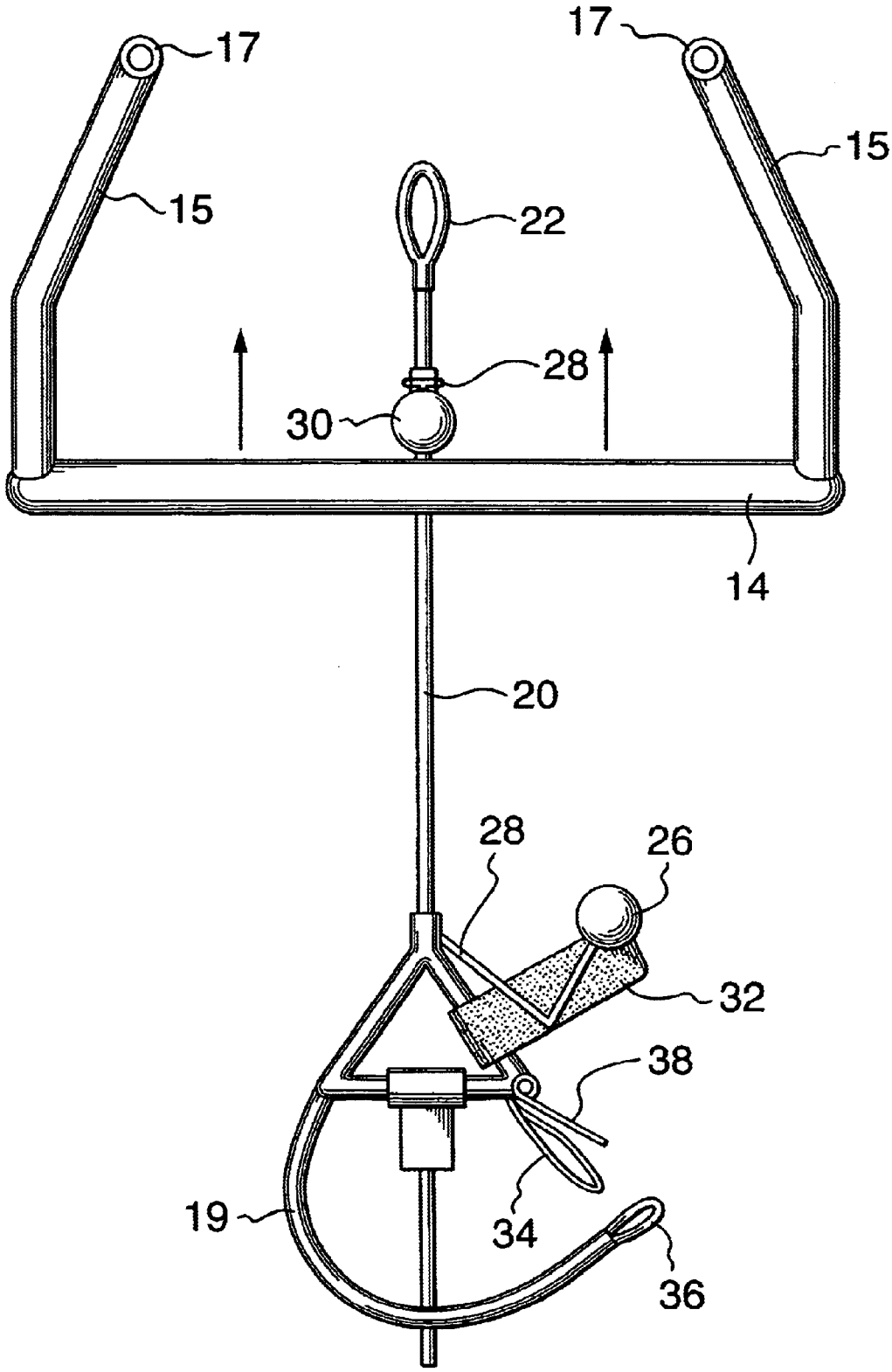
FIG. 5 illustrates a front view of an integrated kite control bar and controlled tension release safety device when activated by moving the control bar against a safety release ball which activates a trigger line.

FIG. 5 illustrates a front view of an integrated kite control bar and controlled tension release safety device when activated by moving the control bar upwardly against a safety release ball which activates a trigger line. As seen in FIG. 5, the control bar 14 has been pushed upwardly by the kite boarder as indicated by the arrows. The control bar 14, when pushed upwardly by the kite boarder, hits the trigger ball 30, which in turn yanks the trigger line 28 which extends downwardly through the interior of the centre line 20. Since the bottom end of the trigger line 28 is secured to the hook and pile fastener 32, it causes the Velcro fastener 32 to unfurl and unwrap from around the one arm of the triangle 24. Since there is a rearward (downward) tension exerted on the depower trim loop 19 by the loop hook 18 of the harness 16, the depower trim loop 19 is pulled downwardly which in turn causes the depower trim hook loop 36 to disengage from the release loop 34 and enable the steel pin 38 to pivot downwardly to an open position, as indicated by the dotted arrow. In this way, the depower trim loop 19 opens and is released from the depower trim loop hook 18 of the harness 16 so the kite boarder is thereby able to release himself or herself from a potentially dangerous or hazardous situation, such as in the case where the wind gusts strongly and the kite 6 pulls the kite boarder off the surface of the water to an elevation at which he or she is not comfortable, or under the water.

Figure 6:
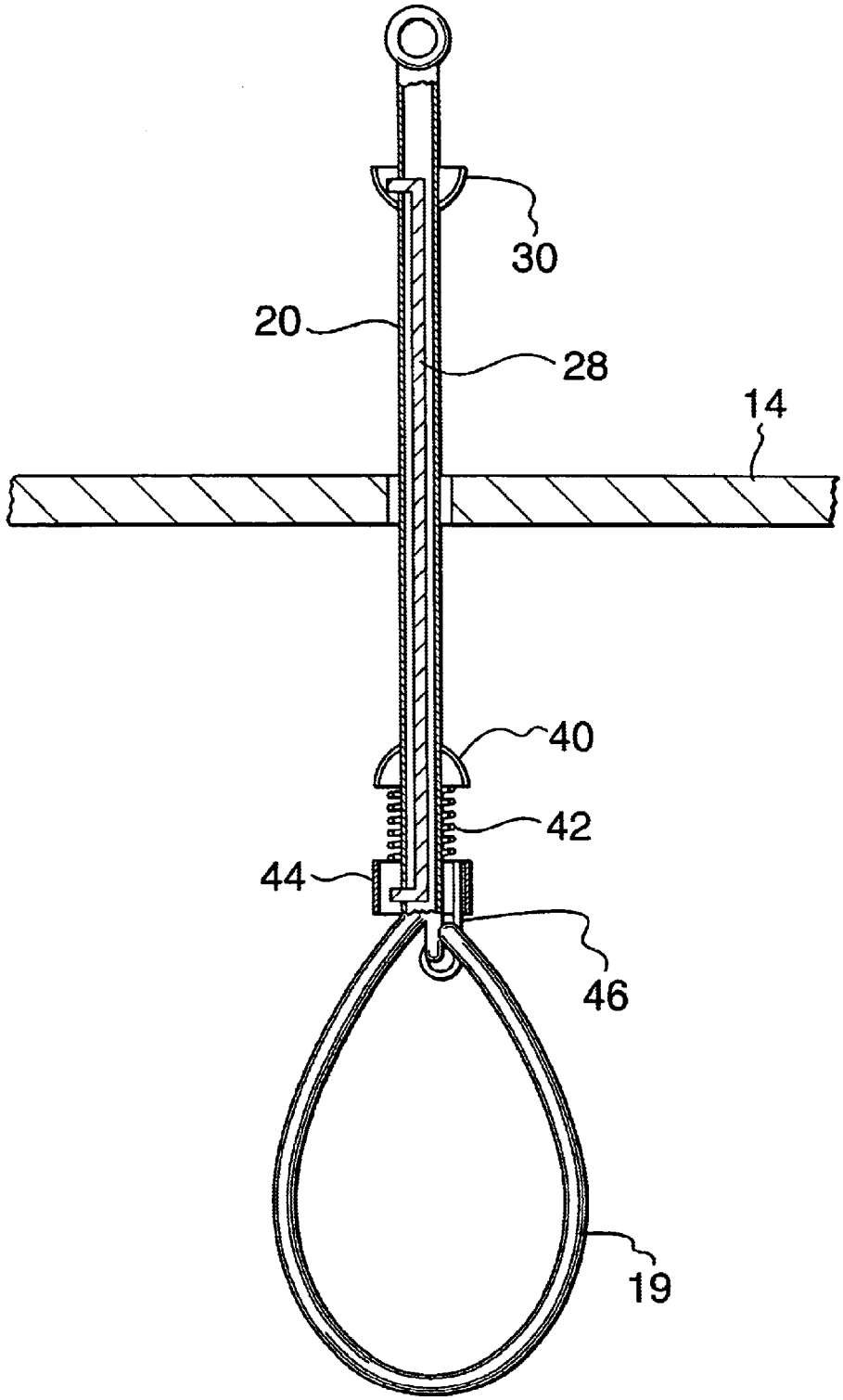
FIG. 6 illustrates a front view of an alternative embodiment of release mechanism.

FIG. 6 illustrates a second embodiment of release mechanism. As seen in FIG. 6, the trigger line 28 and semi-sphere 30 are connected through the interior of the centre line 20 to a semi-sphere 40, spring 42 and hollow pin release catch 44 at the lower end of centre line 20. Hitting the semi-sphere 30 with the control bar 14 raises the trigger line 28 and pulls the pin release catch 44 upwardly against the spring 42 and off the release pin 46. This enables the pivotal release pin 46 to open, thereby releasing the end of the depower trim loop 19 so that it assumes an open position. If desirable, the hollow pin release catch 44 can be threaded on the interior, or equipped with some other adjustable movement mechanism, so that it can be moved relative to the centre line 20, thereby adjusting compression force on the spring 42. In this way, the kite boarder can adjust the releases tension of the overall release mechanism. This prevents premature opening of the release mechanism, but ensures the release catch 44 opens when an unacceptable level of force is exerted on it.

Figure 7:
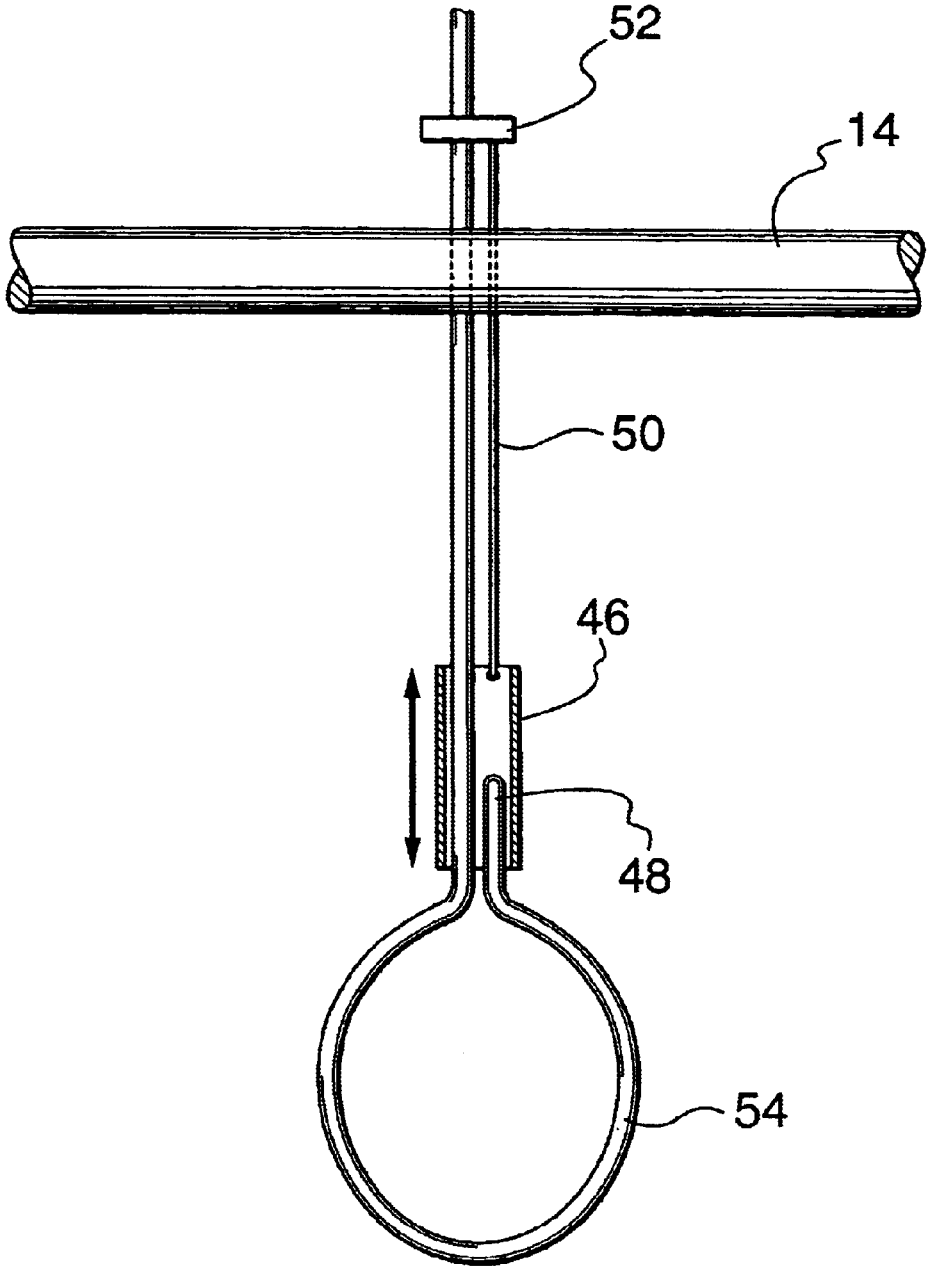
FIG. 7 illustrates a front view of a third embodiment of release mechanism.

FIG. 7 illustrates a third embodiment of the invention and shows a barrel 46 and clip 48 style release mechanism, which permits the user easy access to reconnecting the lines into their loops. The barrel 46 and clip 48 are activated by the control bar 14 being raised upwardly so that it hits the collar 52 and pulls on tension line 50, as described above, acting upwardly on the barrel 46. The barrel 46 is raised upwardly which releases pin 48 and enables loop 54 to open. Although a clip 48 is shown here, mating to the barrel 46, any of several suitable styles of mechanisms as conventionally used in various lock and harness systems can be incorporated to perform the release function. By encapsulating the clip 48 in a soft polymer, it can be made impervious to sand or other contaminants. The use of a soft polymer encapsulant also allows the clip mechanism to act as an effective spring, which can be used to provide a specific resistance so the clip will not release prematurely. Reattachment of the control loop 54 is accomplished by moving the pin 48 to an upright position and moving the barrel 46 over the clip mechanism 48, which is the position shown in FIG. 7.

Figure 8:
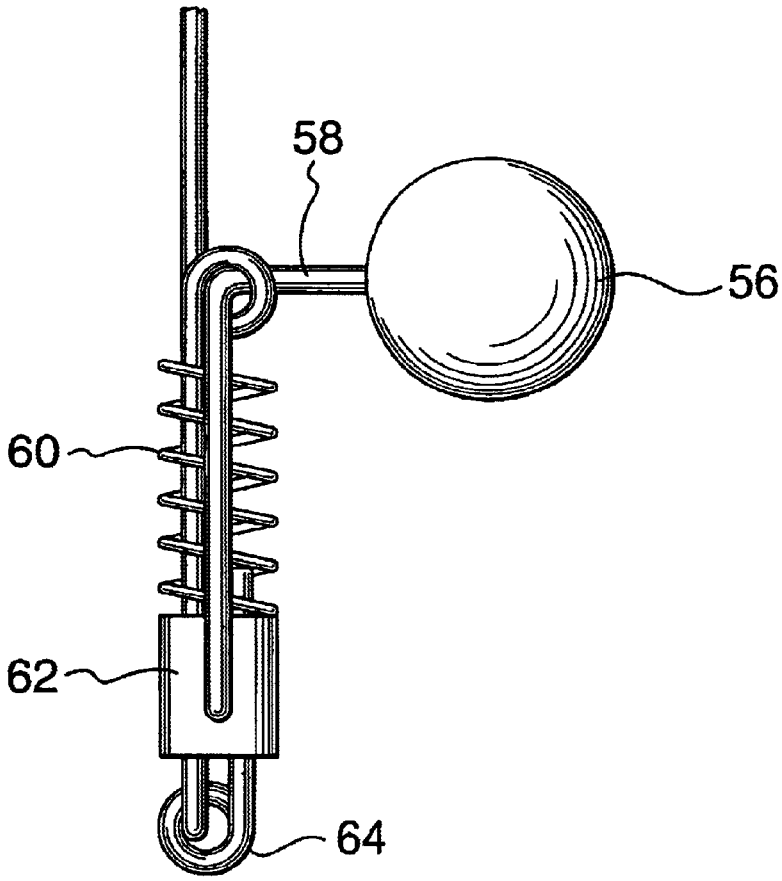
FIG. 8 illustrates a front view of a fourth embodiment of release mechanism.

FIG. 8 illustrates a fourth embodiment of the invention and shows a ball 56 and pin 64 release mechanism which provides a very effective and simple release. This mechanism allows the user, by incorporation of a compression spring 60, to grab the ball 56 and force it upwards and thereby through actuator bar 58, to raise release barrel 62 upwardly so it releases pin 64. This release system, for purposes of understanding, demonstrates use of a compression spring 60. However, in practice, a cellular urethane rubber spring or other similar device can be used instead of a spring to provide improved functionality.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A kite control bar and safety release device comprising:

(a) a kite control bar;

(b) a centre line associated with the kite control bar and having a first end and a second end;

(c) a safety release device associated with the first end of the centre line on a first side of the control bar;

(d) a hook engaging loop associated with the second end of the centre line, on a side of the control bar opposite to the safety release device, and being linked to the safety release device, said loop being openable when the control bar is impinged against the safety release device at the first end of the centre line.

2. A device as claimed in claim 1 wherein the safety release device is linked to the hook engaging loop by a trigger line which passes through the interior of the centre line.

3. A device as claimed in claim 1 wherein the safety release device is linked to the hook engaging loop by a trigger line which passes on the exterior of the centre line.

4. A device as claimed in claim 2 wherein when the trigger line is moved by the safety release device being contacted by the control bar, it activates a release mechanism which enables the hook engaging loop to be opened by being separated at one end from the centre line.

5. A device as claimed in claim 4 wherein the trigger line, when activated by the safety release device, unfurls a hook and pile fastener which secures a free end of the hook engaging loop, thereby enabling the loop to be opened.

6. A device as claimed in claim 4 wherein the free end of the hook engaging loop is connected to the second end of the centre line by a pin and loop combination.

7. A device as claimed in claim 2 wherein the centre line and the trigger line are housed in a hollow tube.

8. A device as claimed in claim 1 wherein the safety release device at the first end of the centre line is a collar or sphere which is connected to a first end of the trigger line which passes through the interior of the centre line.

9. A device as claimed in claim 1 wherein a variable force resistance mechanism is associated with the safety release mechanism.

10. A device as claimed in claim 9 wherein the resistance mechanism is a plastic tubing with slits on its sides covered with a flexible tube.

11. A device as claimed in claim 5 wherein a second end of the trigger line is secured to the hook and pile fastener which when unfurled by tension applied by the trigger line, enables the loop to separate at its free end.

12. A device as claimed in claim 11 wherein a manual release lever is included with the hook and pile fastener and enables the hook and pile fastener to be unfurled separate from the trigger line.

13. A device as claimed in claim 4 wherein the release mechanism is a tube and pin combination, and the trigger line pulls the tube off the pin and releases the pin, and thereby enables the loop to be opened.

14. A device as claimed in claim 13 wherein an adjustable compression or tension device is included with the tube and pin to adjust the release force.

15. A device as claimed in claim 14 wherein the adjustable compression or tension device is a spring.

16. A device as claimed in claim 14 wherein the adjustable compression or tension device is a resilient polymer.

17. A method of releasably securing a kite boarder to a kite which comprises fitting the kite boarder with a harness, the harness being connected to front and back lines of the kite, and a control bar and release safety device is positioned between the harness and the front and back lines of the kite, said control bar and safety release device comprising:

(a) a kite control bar;

(b) a hollow centre line associated with the kite control bar and having a first end and a second end;

(c) a safety release trigger device associated with the first end of the hollow centre line on a first side of the control bar;

(d) a hook engaging loop associated with the second end of the centre line, on a side of the control bar opposite to the safety trigger release device, and being linked to the safety release trigger device, said loop being openable when the control bar is advanced against the safety release device at the first end of the centre line.

18. A method as claimed in claim 17 wherein the kite boarder releases himself or herself from the front and back lines of the elliptical kite by contacting the safety release device with the control bar, thereby enabling the loop to be detached from the harness.

* * * * *